United States Patent [19]

James

[11] Patent Number: 5,072,843

[45] Date of Patent: Dec. 17, 1991

[54] HOLDER FOR INFANT FEEDING DEVICE

[76] Inventor: Bonnie L. James, 237 Birch Rd., Tuckerton, N.J. 08087

[21] Appl. No.: 578,048

[22] Filed: Sep. 5, 1990

Related U.S. Application Data

[63] Continuation-in-part of Ser. No. 414,370, Sep. 29, 1989, abandoned.

[51] Int. Cl.[5] ..... A61J 9/06

[52] U.S. Cl. ..... 215/100 R; 215/11.1; 248/102; 446/73; 446/74; 446/227

[58] Field of Search ..... 215/11.1, 11.6, 100 R, 215/100.5; 242/102, 103, 105, 104; D24/47, 48; 446/73, 74, 227

[56] References Cited

U.S. PATENT DOCUMENTS

| | | | |
|---|---|---|---|
| D. 67,140 | 4/1925 | Dupont | D24/47 |
| D. 141,700 | 6/1945 | Raport | D24/48 |
| D. 145,611 | 9/1946 | Butterfield | D24/48 |
| D. 153,937 | 5/1949 | Graboi | D24/48 |
| D. 160,192 | 9/1950 | Miller | D24/48 |
| D. 176,092 | 11/1955 | Allen | 446/73 X |
| D. 184,455 | 2/1959 | Palmer | D24/48 |
| D. 287,636 | 1/1987 | Callju | D24/47 |
| 530,435 | 12/1894 | Lowerre | 248/102 |
| 2,409,820 | 10/1946 | Zimmern | 215/11.6 X |
| 2,711,052 | 6/1955 | Brayford | 248/102 X |
| 2,744,646 | 5/1956 | Blackstone | 215/11.1 |
| 2,955,382 | 10/1960 | Boles | 46/32 |
| 2,986,296 | 5/1961 | Bannister et al. | 215/11.1 |
| 3,512,301 | 5/1970 | Kramer | 215/11.6 X |
| 4,277,910 | 7/1981 | Kramer | 446/73 |
| 4,295,293 | 10/1981 | Baclft | 446/73 X |
| 4,320,883 | 3/1982 | Bass | 248/104 |
| 4,809,938 | 3/1989 | Skinner et al. | 248/102 |
| 4,895,327 | 1/1990 | Malone et al. | 248/102 |
| 4,902,261 | 2/1990 | Pratt et al. | 215/11.1 X |

FOREIGN PATENT DOCUMENTS

| | | | |
|---|---|---|---|
| 678702 | 1/1964 | Canada | 248/105 |
| 766082 | 1/1957 | United Kingdom | 215/11.6 |
| 1119916 | 7/1968 | United Kingdom | 248/105 |

*Primary Examiner*—Sue A. Weaver

*Attorney, Agent, or Firm*—Panitch Schwarze Jacobs & Nadel

[57] ABSTRACT

A holder for holding a generally cylindrical bottle having an open end and a closed end which comprises a soft, cuddly, plush support member including a body having front and back surfaces forming a three dimensional figure suitable for amusing an infant. The body has a generally circular opening extending completely therethrough from its first surface to its rear surface. The opening is located proximate to the center of the body and is sized for receiving a bottle. The opening includes a ring-like member having an inner diameter at least slightly smaller than the outer diameter of the bottle, so that insertion of the bottle into the opening results in the ring-like member tightly engaging the bottle for gripping and holding the bottle at any selected position along the length of the bottle.

4 Claims, 1 Drawing Sheet

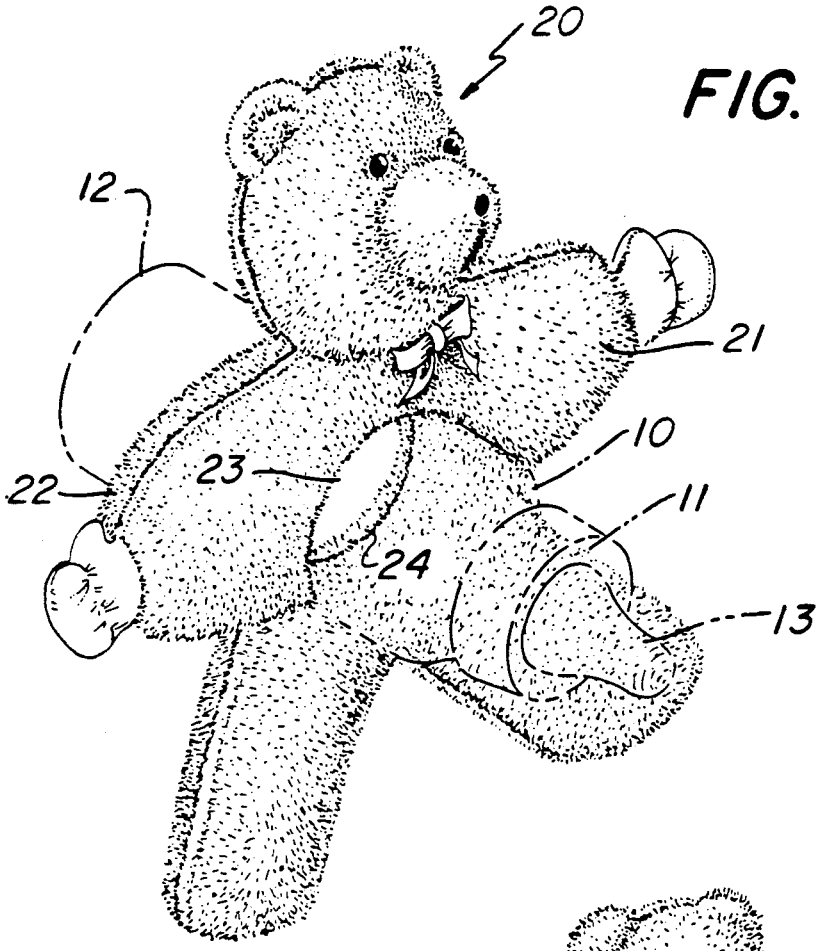
FIG. 1
FIG. 2
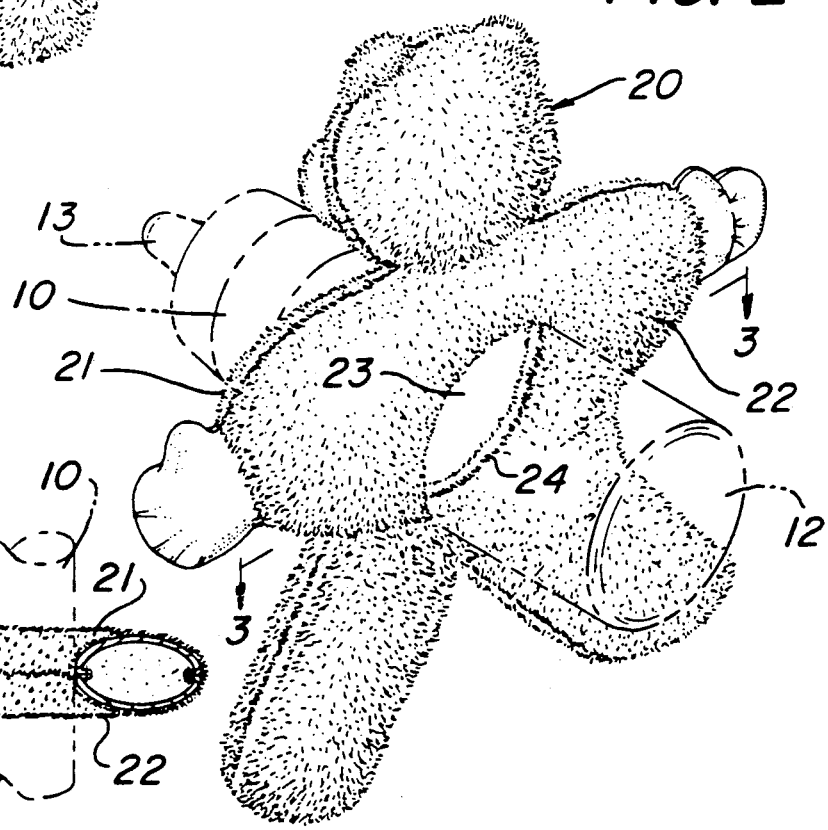
FIG. 3
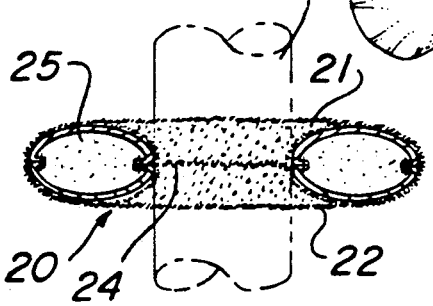

HOLDER FOR INFANT FEEDING DEVICE

CROSS-REFERENCE TO RELATED APPLICATION

This application is a continuation-in-part of applicant's co-pending U.S. Pat. application Ser. No. 414,370 filed Sept. 29, 1989 entitled "The Amusing Bottle" and now abandoned.

FIELD OF THE INVENTION

The present invention relates generally to a device for assisting in the feeding of infants and more particularly to a device for holding a generally cylindrical bottle, such as a baby bottle.

BACKGROUND OF THE INVENTION

Devices to aid the nursing process are known in the art. Generally, such devices have sought to find ways in which to amuse o entertain an infant during nursing in order to hold the child's attention for a sufficient period of time to complete the feeding process.

For example, U.S. Pat. No. 2,955,382 describes a holder for baby bottles which comprises a toy having snap fasteners thereon which are secured to the lower sidewalls of a nursing bottle in a manner so that the infant can observe the toy when nursing. The objectives of this device are to entertain the infant during nursing and to help support the bottle when it is in an upright position for filling or storage.

Other such nursing aids known in the art have as their objective to support a bottle and to amuse an infant during feeding so that the child does not lose concentration during the nursing process. For example, U.S. design Pat. Nos. D145,611; D153,937 and D160,192, as well as utility U.S. Pat. Nos. 4,902,261 and 2,711,052 disclose devices which are in the shape of plush toys or characters. These devices all attach in some manner to an infant's nursing bottle in order to support the bottle at a particular orientation and to amuse a feeding infant.

Other devices are known which seek to aid the nursing process by holding a baby bottle in place during feeding, thereby removing the necessity of having an adult hold the bottle during the course of the entire feeding. For example, British Patent No. 1,119,916 discloses a baby bottle holder which comprises a support having a flat surface and a bottle supporting surface which holds the bottle in a downward position so that the child may be fed without the necessity of an adult having to hold the bottle for the infant. U.S. Pat. Nos. 530,435 and 4,809,938 disclose similar types of baby bottle supports which also allow for an infant to be fed without the aid of an adult.

In contrast to these known devices, the present invention is directed to a device for amusing and/or entertaining an infant during nursing and for supporting a baby bottle in such a manner so that it extends at an upward angle when not in use.

SUMMARY OF THE INVENTION

Briefly stated, the present invention is a device for holding a generally cylindrical bottle having a closed end and an open end including a nipple, comprising a soft, cuddly, plush support member. The support member has a body having front and rear surfaces forming a three dimensional figure suitable for providing amusement to an infant during feeding. The body contains a generally circular opening located proximate the center of the body which is sized for receiving the bottle. The opening contains a generally non-expandable ring-like member having an inner diameter at least slightly smaller than the outer diameter of the bottle. Insertion of the bottle into the opening results in the ring-like member tightly engaging the bottle for gripping and holding the bottle at any selected position along the length of the bottle to permit a desired position of the open end of the bottle to extend beyond the opening. The support may preferably be in the form of a toy, such as a stuffed animal or the like.

BRIEF DESCRIPTION OF THE DRAWINGS

For the purpose of illustrating the invention, there is shown in the drawings forms which are presently preferred; it being understood, however, that this invention is not limited to the precise arrangements and instrumentalities shown.

FIG. 1 is a front perspective view of a device for receiving and holding a baby bottle in accordance with the present invention;

FIG. 2 is a rear perspective view of the device of FIG. 1; and

FIG. 3 is a sectional view of the device taken along line 3—3.

DETAILED DESCRIPTION OF THE INVENTION

Referring to the drawings, wherein like reference numerals are used to indicate like elements throughout the figures, the present device may be used with any conventional infant nursing bottle having open 11 and closed ends 12, the open end 11 housing the nipple 13. Ordinarily, infant nursing bottles are of a generally cylindrical, or six-sided construction with a neck portion within which the base of the nipple is maintained in position. However, baby bottles of any shape or size may be used with the present invention, as long as the bottle can be held by the support member 20. The use of baby bottles of other shapes or sizes for particular applications will be evident to one of ordinary skill in the art from the present disclosure.

When using the present device, the bottle 10 is releasably attached to the support member 20 by insertion of the bottle 10 into the circular opening 23 in the body of the support member 20. The support member 20 may be in the shape of a character or toy in order to cause amusement of the infant during feeding. For example, the support member 20 may be in the shape of a toy, a teething ring, a squeak toy, a rattle, a musical toy or other character or object which would entertain or amuse the child.

The present device simultaneously supports the bottle 10 during feeding and amuses the child. Moreover, the infant can grasp or otherwise engage the body of the support member 20 of the device thereby further supporting the bottle. When not in use, and when the bottle is placed down on a table or the like, the present device also provides support for the bottle. This is advantageous from the viewpoint of convenience when filling the bottle and for preventing the bottle from tipping over.

The support member 20 of the present device may be fabricated of any appropriate substance and is not limited to a particular composition. For example, the support member 20 may be fabricated of a hard or soft plastic, a textured fabric, fake fur, other man-made fabric (such as polyester, nylon, rayon, etc.), etc. Appropriate substances for the present support member 20 will be evident to one of ordinary skill in the art based upon the present disclosure. However, the substance chosen for the support is preferably non-toxic in order to protect the infant's safety.

Preferably, the support member 20 will be in the form of a stuffed animal which is formed of textured fabric, fake fur or other man-made fabric. As can best be seen in FIG. 3, when the support member 20 is in the shape of a stuffed animal, it may be filled with an appropriate fiber-fill or man-made stuffing (designated by 25), such as foam rubber, etc. However, the filling or stuffing should also be non-toxic from the viewpoint of safety. Appropriate stuffing materials will be evident to the artisan based upon the present disclosure.

The support member 20 may be of any size, so long as the objectives of amusing the child and supporting the bottle 10 are achieved. However, preferably, the support member 20 is generally about 240 to about 250 millimeters in width and about 240 to about 250 millimeters in height. Support means of this size are advantageous as they are large enough to provide good support for the bottle and yet are not too large to prevent the infant from grasping the support.

The support member 20 comprises a body portion which contains a generally circular opening 23 through the body from its front surface to its rear surface. The opening 23 is located proximate the center of the body. The opening 23 includes a bottle gripping portion formed of a generally non-expandable ring-like member 24. The ring-like member 24 should have an inner diameter at least slightly smaller than the outer diameter of the bottle 10. Preferably, the opening 23 is about 50 to 60 millimeters in diameter. The opening 23 must extend through the entire support member 20, from its front surface 21 to its rear surface 22 so that both the open 11 and closed ends 12 of the bottle 10 extend outwardly from the opposing front 21 and back 22 surfaces of the support member 20. When placed in the support member 20 in this manner, the open end 11 of the bottle 10 (i.e., the end which houses the nipple) will extend in an upward position while the closed end 12 of the bottle 10 will generally extend downwardly.

When the bottle 10 is inserted into the opening 23 in this manner, the ring-like member tightly engages the bottle 10 for gripping and holding the bottle 10. The bottle 10 may be held at any selected position along the length of the bottle 10. This will permit a desired portion of the open end 11 of the bottle 10 to extend beyond the body of the support member 20.

The device of the present invention may be used with conventional infant nursing bottles and the infant may be fed in the same manner as with any other, conventional nursing bottle. For example, the bottle should be filled with the material to be fed to the infant, inserted through the opening 23 in the support means 20, and the infant may then be fed in the usual manner. However, when the child is being fed with the present device, and the support means 20 is in the form of a toy or other character, the infant will be focusing his or her view on the support means 20 positioned directly within his or her line of sight, thereby focusing the child's attention upon the support means 20 and amusing the child. Moreover, during feeding, the present device supports the bottle 10, allowing the child to nurse without the aid of an adult.

Also the body of the support means 20 is engageable by the infant to support the bottle 10 at a suitable position to facilitate feeding of the infant while providing amusement to the infant. That is, the infant may grasp or otherwise engage the present device during feeding, providing increased support for the bottle.

Moreover, when feeding is complete and the bottle and the present device are placed down on a table or the like, the present device provides added support for the bottle, preventing it from being easily tipped over. The support provided by the present device is advantageous in preventing spillage of the infant formula or the like from the bottle. When the device and bottle are placed down, the top end of the baby bottle (which houses the nipple) will extend through the opening in the support means in an upward direction. This positioning of the bottle also aids filling of the bottle.

The present invention may be embodied in other specific forms without departing from the spirit or essential attributes thereof and, accordingly, reference should be made to the appended claims, rather than to the foregoing specification, as indicating the scope of the invention.

What is claimed is:

1. A holder for holding a generally cylindrical bottle having a closed end and an open end including a nipple for use in feeding an infant, the holder comprising:

a soft, cuddly, plush support member including a body having a front surface and a rear surface, a head extending outwardly from the body and four appendages extending outwardly from the body at spaced locations, the body, head and appendages cooperating to form a three dimensional figure of a type suitable for providing amusement to an infant during feeding; and a generally circular opening extending completely through the body from its front surface to its rear surface, the opening located proximate the center of the body and being sized for receiving the bottle, the opening including a bottle gripping portion formed of a generally non-expandable ring-like member having an inner diameter at least slightly smaller than the outer diameter of the bottle whereby insertion of the bottle into the opening results in the ring-like member tightly engaging the bottle for gripping and holding the bottle at any selected position along the length of the bottle to permit a desired portion of the open end of the bottle to extend in an upward direction beyond the body and to permit the closed end of the bottle to extend in a downward direction; the body, head and appendages being engageable by the infant to support the bottle at a suitable position to facilitate feeding of the infant while providing amusement to the infant.

2. A device as in claim 1, wherein said opening is about 50 to 60 millimeters in diameter.

3. A device as in claim 1, wherein said support means is about 240 to 250 millimeters in width.

4. A device as in claim 1, wherein said support means is about 240 to 250 millimeters in height.

* * * * *